United States Patent [19]

O'Sullivan et al.

[11] 4,080,806

[45] Mar. 28, 1978

[54] KNITTING MACHINE

[75] Inventors: James C. O'Sullivan, Sutton; Patrick J. McAvoy; Glynn B. Jeffery, both of Dublin, all of Ireland

[73] Assignee: Institute for Industrial Research and Standards, Dublin, Ireland

[21] Appl. No.: 765,310

[22] Filed: Feb. 3, 1977

[51] Int. Cl.[2] ..... D04B 7/04

[52] U.S. Cl. ..... 66/64

[58] Field of Search ..... 66/60, 60 H, 64

[56] References Cited

U.S. PATENT DOCUMENTS

| | | | |
|---|---|---|---|
| 3,049,900 | 8/1962 | Bram | 66/60 |
| 3,153,922 | 10/1964 | Bram | 66/64 |
| 3,613,401 | 11/1969 | Jeffcoat et al. | 66/60 |
| 3,685,317 | 8/1972 | Giachetti et al. | 66/64 |
| 3,839,884 | 10/1974 | Flavell et al. | 66/64 |
| 3,842,623 | 10/1974 | Flavell et al. | 66/64 |
| 3,952,553 | 4/1976 | Kohler | 66/64 |
| 3,973,416 | 8/1976 | Kohler | 66/64 |
| 4,027,504 | 6/1977 | Dietschy et al. | 66/64 |

*Primary Examiner*—Ronald Feldbaum
*Attorney, Agent, or Firm*—Diller, Brown, Ramik & Wight

[57] ABSTRACT

A knitting machine having two opposed arrays of latched needles arranged in respective flat needle beds and means for actuating the needles of the arrays independently in succession along the arrays, the actuating means being borne by a carriage mounted above and movable back and forth longitudinally along the needle beds, the machine further including an elongated restraining element extending longitudinally between the needle beds, a housing to support and contain the restraining element, the restraining element also extending longitudinally between the needle beds, both housing a restraining element being borne by the carriage on a substantially horizontal support member for movement therewith, the element and the housing being relatively movable longitudinally of the needle beds whereby the element can be brought to an operative position projecting from the housing or to an inoperative position retracted in the housing, and actuator means for causing the restraining element to be in its operative position during carriage motion in one direction and for causing the restraining element to be in its inoperative position during carriage motion in the opposite direction, wherein when the element is in its operative position it extends from the trailing end of the housing into an active knitting field and below the arch of the extended needles to hold down the loops on rising needles thereof.

13 Claims, 6 Drawing Figures

KNITTING MACHINE

This invention relates to knitting machines.

In the knitting sequence on an automatic knitting machine of the V-bed type, knitting needles move transversely in the front and rear beds forming the inverted V, so as to interleave with each other in the knitting area and over the gap between the beds. Each knitting needle is advanced through a previously knitted loop to collect the newly fed yarn which is drawn into the hook of the knitting needle. A new loop is formed by drawing the newly fed yarn through the old loop by means of the knitting needle as it descends into the bed, and the old loop closes a latch over the hook of the knitting needle so that the old loop slides up the needle past the hook which retains the loop. At a position of retraction of the needle known as "knockover," the old loop is cast off the knitting needle which continues its descent to a position which determines the size of the new loop.

The juxta-position of successive needles in front and rear beds forming the V-bed and their interleaving one with the other determines the form of stitch sequence knitted in each course of knitting. The carriage which actuates the needles passes over the beds bringing with it the yarn feeding machanism for depositing the new yarn in the opened hooks as they are advanced and retracted by the cam system carried on the underside of the moving carriage closely over the bed surfaces.

Successive courses are knitted as the carriage is reciprocated over the length of the beds and these successive courses constitute the length of the knitted piece of fabric which then descends through the gap between the two beds. If insufficient tension is provided to the knitted fabric in a direction down through the gap, the formed loop will ride up with the knitting needle as it ascends (to a position known as a "clearing height" at which the old loop would normally fall below the latch) and fail to fall below the latch. Therefore, regular formation of successive knitted courses will not result.

It has been the practice in the past to provide a powered take-down system or a system of loading weights on the length of knitted fabric so that a tension transmitted through the length of the fabric is maintained on the formed loops. This ensures adequate loop formation and removal of the formed loops from the retracting needles (knockover) towards the end of each needle movement sequence.

Sufficient loop tension may be provided alternatively by the pressure of a needle-like device which is drawn along by the carriage slightly in advance of the knitting sequence region (referred to herein as the active knitting field) which is controlled by cam boxes in the carriage, the needle device extending backwards into the space beneath the raised (active) knitting needles and above the previous knitted course. This will provide tension in the knitted loops by means of pressure exerted vertically downward on the previous course (as compared with a tension transmitted through the fabric from below the gap in the previously described take-down mechanism). Such pressure has been shown to be sufficient to ensure adequate loop formation without the need for take-down tensioning devices.

This carriage-borne needle device is known as a restraining element. The operation of the restraining element removes the necessity for the application of tension from below to the knitted course.

The object of this invention is to provide a means of achieving a restraining element activity in the active knitting field of V-bed knitting machines in particular, although the invention is also applicable to flat bed machines when appropriately designed for those applications.

Accordingly, the invention provides a knitting machine having two opposed arrays of latched needles arranged in respective flat needle beds and means for actuating the needles of the arrays independently in succession along the arrays, the actuating means being borne by a carriage mounted above and movable back and forth longitudinally along the needle beds, the machine further including an elongated restraining element extending longitudinally between the needle beds, a housing for the restraining element also extending longitudinally between the needle beds, both the housing and the restraining element being borne by the carriage for movement therewith, the element and the housing being relatively movable longitudinally of the needle beds whereby, the element can be brought to an operative position projecting from the housing or to an inoperative position retracted in the housing, and actuator means for causing the restraining element to be in its operative position during carriage motion in one direction and for causing the restraining element to be in its inoperative position during carriage motion in the opposite direction, wherein when the element is in its operative position it extends from the trailing end of the housing into an active knitting field to hold down the loops on rising needles thereof.

In a preferred form of the invention there is provided a machine as defined above including a second restraining element borne by the carriage, wherein the second element also can be brought, by a relative movement longitudinally of the needle beds, to an operative position extending from the trailing end of a housing, which may be the same housing as the first housing or a separate second housing, or to an inoperative position retracted in the housing, and wherein the actuating means further operates to cause the second element to be in its inoperative position during carriage motion in the said one direction and in its operative position during carriage motion in the said opposite direction.

In one embodiment of the invention a separate second housing is provided for the second element, the second housing being spaced from the first housing with an active knitting field between them during motion of the carriage, and a different element extends into the active knitting field for each direction of motion of the carriage.

In the second embodiment of the invention a separate second housing is provided for the second element, the second housing being spaced from the first housing with two active knitting fields between them during motion of the carriage, a first of the fields being adjacent the first housing and the second of the fields being adjacent the second housing with an inactive region of the arrays between the two fields, and during carriage motion in the one direction the first restraining element extends into the first field and during carriage motion in the opposite direction the second element extends into the second field, the machine further including a third housing extending longitudinally between the needle beds in the inactive region of the arrays, and third and fourth restraining elements coupled together end to end in the third housing, the coupled third and fourth elements and the third housing being relatively movable longitudinally of the needle beds whereby either one of the third and fourth elements can be brought to an operative position extending from a respective end of the third housing with the other element in an inoperative position retracted in the housing, the actuating means further operates to cause the third element to be in its operating position during motion in the one direction and the fourth element to be in its operating position during motion in the opposite direction, the arrangement being such that in the operative position the third element extends into the second field and the fourth element extends into the first field.

The mounting of the restraining elements to the carriage requires that positioning devices are incorporated in the mounting so that the vertical and transverse siting of the restraining elements and housings relative to the bed gap may be accurately adjusted. These positioning devices are not described in the following detailed description but it is to be understood that they are present and may be readily incorporated by one skilled in the art. The length of the operative restraining element is determined by the need for the tip of the operating needle to extend at least to the point in the active knitting field at which the new yarn is laid into the knitting needles, and preferably to the point at which knockover occurs.

The reversals of the position of the restraining elements at each carriage reversal may be independent of each other or articulated by a linkage between the restraining elements, and it is important that the inoperative element is shielded from interfering with the current knitting sequence by retraction within a housing.

A third embodiment of the invention uses a restraining element assembly consisting of two colinear elements linked to a central cam and a single mobile housing which slides relative to the carriage longitudinally of the beds. The extent of the movement of the housing is such that for a given direction of movement the housing shields the forward element of the two and exposes the rearward trailing element which is then operative in the active knitting field, the housing being sited just ahead of the active knitting field for the given direction of travel of the carriage along the needle beds. At the limit of carriage movement a fixed actuator moves the housing from one extreme to the other of slide movement and in the process the cam is moved a limited distance necessary to re-position the elements for the return motion. This embodiment of restraining element and housing design has the virtue of compactness and simplicity in operation and may be associated with switches which stop the motion of the carriage if the re-positioning of housing and needles is not appropriate to the forthcoming knitting sequence.

In all embodiments of this invention, the housings are arranged to travel in the gap between the needle beds and to move longitudinally on the needle beds. The housings are positioned within the gap to provide conditioning pressure on the existing knitted courses. To facilitate entry on to the existing courses following reversal of the carriage at the bed ends the two ends of the housing are shaped downwardly and rearwardly from the tip of the housing at an angle of substantially 45°. In addition, since the housings are supported from the carriage by a substantially horizontal member extending from one side of the carriage and enter transversely into the gap, the yarn from the yarn feeders must be prevented from attaching to the housing. Thus the horizontal contour of the housing ends is shaped in an approximate part circle to sweep the knitting yarn away from the support member of the housing and into the space remaining between the housing side and the remote needle bed and prevent attachment of the yarn to the housing as it traverses the existing knitted course. A passage space of dimension very slightly greater than yarn diameter is provided between the housings and the other side needle bed to facilitate passage of the housing smoothly past the yarn attached between the knitted fabric and a yarn feeder at rest.

The underside of each housing between the ends of the housing may be substantially parallel with the knitted course or gently inclined downwardly to the centre region of the housing so as further to condition the course downwardly into the bed gap for either direction on movement of the housing over the knitted course.

Embodiments of the invention will now be described, by way of example, with reference to the accompanying drawings, in which.

Figure 1:
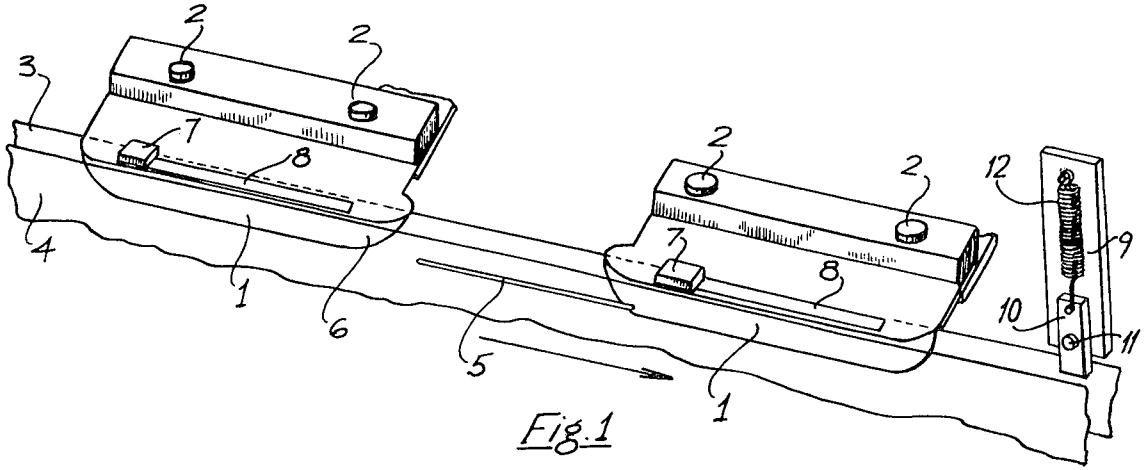
FIG. 1 is a schematic perspective view of a first embodiment of the invention.

In FIG. 1 only those parts of the knitting machine are shown which are necessary for explaining the embodiment of the invention. Thus the complete machine, which is of the V-bed type, will comprise two opposed arrays of knitting needles arranged in respective flat needle beds, and a carriage mounted above and movable back and forth longitudinally of the needle beds, the carriage serving to actuate the knitting needles in succession along the arrays as it passes in each direction relative to the beds. The parts of the machine not shown may be entirely conventional.

Referring now to FIG. 1, a pair of restraining element housings 1 are mounted by bolts 2 to the carriage (not shown) of a knitting machine. Each housing extends parallel to the direction of movement of the carriage between the opposing knitting needle beds 3 and 4 of the machine, and houses a respective restraining element 5. Each element 5 has an operative position wherein it projects from one end of its associated housing through a small opening 6 and wherein it extends parallel to the direction of movement of the carriage in contact with the knitting to exert the desired downward pressure on the knitting to provide sufficient loop tension.

In the figure, the carriage is assumed to be travelling to the right and the element 5 associated with the right hand housing 1 is in its operative position, the current knitting area being generally between the two housings 1.

Thus, in the operative position, the element 5 trails behind its associated housing 1 and extends backwards into the space beneath the knitting needles and above the previous knitted course.

Each element 5 further has an inoperative position in which it is retracted into its housing 1 by movement along its own axis parallel to the direction of movement of the carriage. The element 5 associated with the left hand housing 1 in the figure is assumed to be retracted into its inoperative position. This element is used for the return direction of motion of the carriage, i.e., motion to the left as viewed in the figure, during which motion it extends from its housing into the region between the two housings in a similar manner to that shown in the figure for the element 5 associated with the right hand housing 1. During this return motion to the left, the right hand element 5 is in its retracted or inoperative position.

Thus it will be seen that a separate element 5 is used for each direction of movement of the carriage, the element currently in use extending from the trailing end of its housing and the element not in use being retracted into its housing. At each reversal of the carriage motion the operative element is retracted and the previously inoperative element is extended in readiness for knitting the next course.

The means by which each element 5 is alternately extended and retracted at opposite ends of the carriage path is as follows. Each element 5 is attached to a cam 7 which slides in a slot 8 along the top each housing. When a cam 7 is slid along the slot towards the gap between the housing 1, the associated element 5 is extended into its operative position and when a cam 7 is slid along its slot away from the gap between the housings 1, its associated element 5 is retracted into its inoperative position.

At each end of the carriage travel an actuator stop 9 is provided (only one is shown, for the right hand end of the machine). Each actuator stop comprises a vertical bar 10 pivotted at 11 for rotation about a horizontal axis perpendicular to the direction of motion of the carriage. The bar 10 is normally held vertical by a spring 12.

Towards the end of the carriage motion to the right, the right hand housing 1 passes under the bar 10. The positioning of the bar 10 is such that it just clears the top of the housing but abuts against the right hand edge of the cam 7. Since the cam 7 is already fully to the left in the slot 8, the bar 10 merely rides over the cam 7 by deflection of its lower end to the right against the force of the spring 12, which latter restores the bar to a vertical position as soon as the bar clears the cam 7. The right hand element 5 thus remains extended. In a similar manner, the left hand housing 1 passes under the bar 10, and again the bar merely rides over the cam 7, since this cam also is fully to the left in its slot 8. The element 5 associated with the left hand housing thus remains retracted.

At some point when both the housings 1 have passed under the actuator 9, the carriage motion is reversed. This time, the bar 10 meets the left hand edge of each cam 7 and pushes the cam fully to the right along its respective slot 8 before riding up over it. In this way, the element 5 associated with the left hand housing is extended into its operative position and the element 5 associated with the right hand housing is retracted into its inoperative position inside its housing.

The restraining elements 5 are now properly set for the knitting sequence during the return movement to the left.

At the left hand end of the machine a similar actuator stop to that shown at 9 is positioned, which once again reverses the positions of each element so that they once again assume the positions shown in FIG. 1 ready for the knitting sequence to the right.

Figure 2:
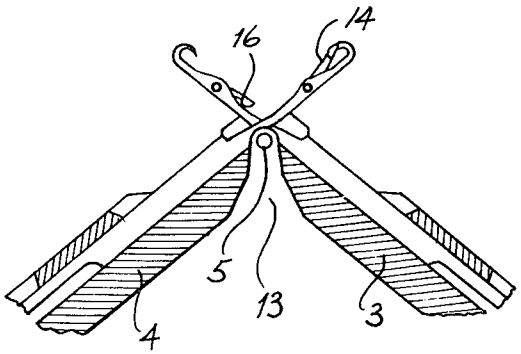
FIG. 2 is a diagram showing the position of the restraining element of FIG. 1 relative to the advanced knitting needles from each machine bed, the view being transverse the needle beds.
Figure 3:
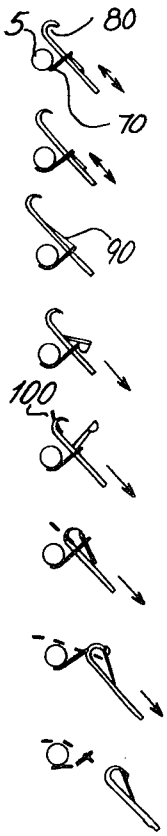
FIG. 3 is a diagram showing the position of the restraining element relative to a single active needle and the sequence of the knitting action during a full cycle.
Figure 4:
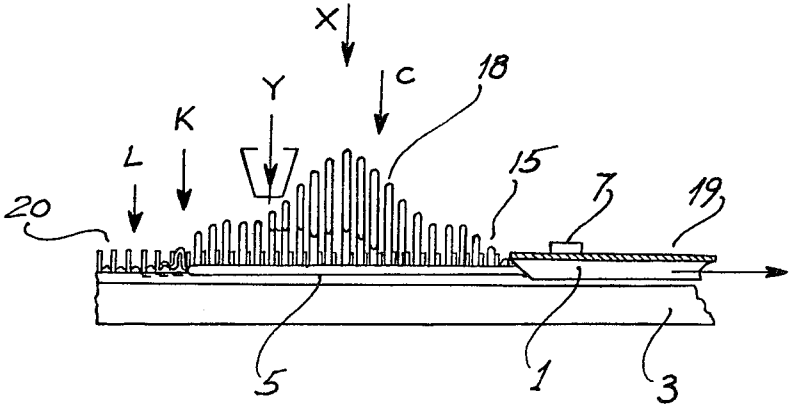
FIG. 4 is a diagram showing in side view the position of the restraining element and its housing relative to the whole active knitting field.

The position of each element 5, when in its operative extended position, is more clearly seen in FIGS. 2 to 4. In FIG. 2 two knitting needles are shown advanced one from each bed 3 and 4 in a direction transverse to the gap 13 between the two beds which are shown in cross section. One needle is shown with its latch 14 closed and the other with its latch 16 in the opended position and beneath the arch formed by such needless is shown the restraining element 5 which in the present case is of circular cross-section. The needles are constrained to move from their position most advanced as shown to a transversely retracted position in which the hook of each needle is withdrawn behind the verge of its bed and during this sequence of movement the knitting action takes place as illustrated in FIG. 3.

FIG. 3 is a sequence of drawings to illustrate the important stages of the knitting cycle involving the creation of a new loop of yarn. In position (*a*) the knitting needle is advancing transversely to the gap between the beds of the knitting machine, that gap containing the restraining element 5 shown in cross section in the illustrations of FIG. 3. In position (*a*) a loop of yarn 70 is shown over the needle shaft and within the hook area 80 beginning to open the latch 90 which may have been previously closed. Position (*b*) shows the needle further advanced and the loop 70 fully opening the latch and beginning to move over it. In position (*c*) the needle has advanced near to the fully advanced state and has carried the latch 90 through the loop 70. As the needle now retires to position (*d*) the loop 70 passes behind the latch 90 and starts to close it. If during the preceding three positions the restraining element 5 had not been present to restrain the loop 70 it may have advanced with the needle and not come to a position behind the latch 90, and the following sequence of knitting events could not have happened. As the needle retires to position (*e*) the loop 70 acts to close the latch 90 but at this time further yarn 100 is introduced from the yarn feeder associated with the carriage motion (but not shown here) into the open hook 80 of the needle. When the needle is further retracted to position (*f*) the restrained loop 70 closes the latch 90 over the hook area 80 holding the newly introduced yarn 100 and as the needle further retires to position (*g*) the loop 70 passes over the needle hook now closed and the new yarn 100 is drawn into a loop. As the needle retires to position (*h*) the new loop length through the old loop (10) which falls off the retiring needle hook; this position (*g*) is the position called knockover and this event might not have occurred if a restraining force as is provided by the restraining element 5 had not been present.

Figure 5:
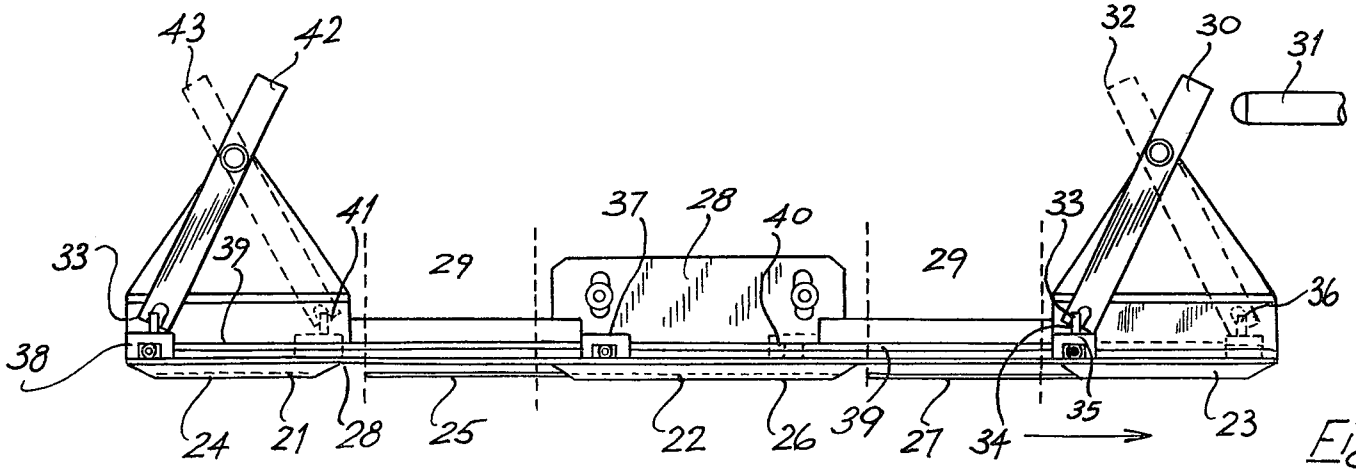
FIG. 5 is a side view of a second embodiment of the invention for use in a double system knitting machine.

The sequence is further illustrated by the side view of FIG. 4 in which the restraining element 5 carried from housing 1 is moving progressively in the direction shown by the arrow, the housing 1 terminating just before the first rising needle 15 of the active knitting field to avoid interfering with that needle. The illustration shows one set of knitting needles from one bed 3 as they would appear when viewed from the other needle bed, the needles of which have been omitted from this illustration together with the knitted material. The restraining element 5 stretches rearward from the housing 1 beneath the series of advanced needles 18 and is attached to the cam 7 within the housing 1, the housing itself being supported by a substantially horizontal member 19 shown in cross section which is attached to the carriage above the needle bed. Since the knitting sequence shown in FIG. 3 occurs on successive needles above the restraining element 5 it is necessary that the element 5 is suspended from a point in advance of the active knitting needles 18. At the point C in FIG. 4 the restrained loop (position (c) of FIG. 3) falls behind the latch of the needle, and this height of advance of the needle is known as the clearing height. The maximum point of advance of the needles is shown at position (X) in FIG. 4, the later needles in this illustration (i.e., those to the left as viewed) having already passed through that position to a point Y in FIG. 4 which shows the yarn being fed to the open hooks of the needles at that position. At position K the needles are in the state of retraction below the verges 20 of the bed 3 at which the knockover event occurs. It is to be borne in mind that the above description of the position of an operative element 5 relative to the active knitting field is applicable also to the restraining elements of the following embodiments when in their operative position. In FIG. 5 is shown as assembly of three housings (21, 22 and 23) and restraining elements (24, 25, 26 and 27) mounted on a supporting member 28 which in turn is secured to the machine carriage (not shown). The elements are shown in FIG. 5 properly positioned for motion of the whole assembly mounted on the machine carriage to the right as shown by the arrow. Knitting action is taking place in the region between the dotted lines 29 just above the restraining elements 25 and 27. The restraining elements 24 and 26 retracted into housings 21 and 22 are taking no part in the knitting action in the direction of movement illustrated and the housing 21 is providing further conditioning of the already knitted courses after the knitting areas 29. When the carriage and supported assembly approaches the right hand end of travel the lever 30 approaches a fixed actuator stop 31 and as motion further progresses the lever is moved by the actuator stop to position 32. The lever end 33 engages a pin 34 in the cam 35 and moves the cam 35 to position 36. As the cams 35, 37 and 38 are linked by a rod 39 all three cams associated with the four restraining elements are moved to the new positions 36, 40 and 41 thus retracting restraining elements 25 and 27 and extending elements 24 and 26 from the right extremities of housings 21 and 22 and housing 23 then acts as the trailing conditioning housing for reversed motion to the left knitting beds. It will be seen that cam 36 operates both elements 25 and 26, which extend in opposite direction from the cam 36, although only one element 25 and 26 projects from the housing 22 at a time. Since lever 42 is linked to cam 38 and is in a position 43 during movement to the left, it will act at the left end of the needle beds to return the arrangement to the original position when lever 42, in the position 43, meets the actuator stop (not shown) at that end and is moved to the original position thereby.

Figure 6:
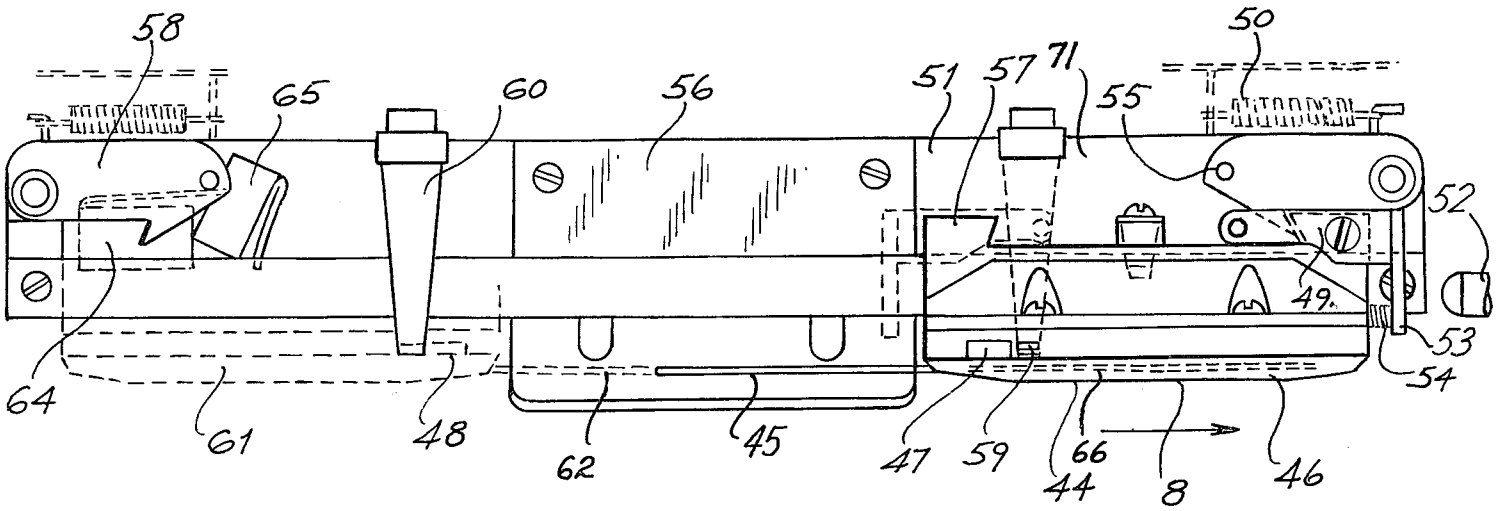
FIG. 6 is a side view of a third embodiment of the invention for use in a single knitting machine.

FIG. 6 shows an embodiment in which a single housing 44 is used in conjunction with two restraining elements 45 and 46 mounted on a central cam 47 and shows the elements positioned for motion to the right in the direction of the arrow. The housing is supported by member 71 which is able to slide along a slide bar 56 from one end to the other, the end positions of the housing being on either side of the active knitting field. The member 71 is horizontal and at a lower level than the yarn feeder machanism to allow the member 71 to pass beneath all the feeds of the knitting machine. The support member 71 and hence the housing 44 are held at the right end of the slide bar and prevented from moving towards the other end by a latch 48 which engages a re-entrant piece 49 (shown dotted) of the support assembly and which is restrained there by a spring 50.

As the support member and slide, which is mounted on back plate 51, approaches the end of the needle bed the back plate 51 continues moving with the carriage to which it is rigidly attached but fixed actuator stop 52 meets a lever 53 and depresses it against a spring 54, and a pin 55 on the lever lifts the latch 48. The sliding support member 71 is thus released and allows the slide bar 56 to slide through the support member 71 which is restrained by actuator stop 52. At the full extent of carriage movement re-entrant member 57 engages with a latch 58 and the housing is brought to the correct position in advance of the knitting field for the subsequent return motion to the left. During the process of sliding, the housing 44 carries a cam member 47 away from the cam stop member 59 towards cam stop member 60. When the cam engages the cam stop member 60 and the housing continues to the left end of slide bar to the position 61 the cam 47 slides within the housing to a new position 48 and in the process retracts restraining element 45 into the housing and extends restraining element 46 into the position shown at 62 the latter element thus being correctly positioned for restraining work during the return motion to the left. A similar arrangement to that of the components 53 and 54 lifts the latch 58 when a fixed actuator stop (not shown) at the left end of the needle beds contacts the equivalent to the lever 53 towards the extremity of travel in that direction and the mechanism is returned to its original state. Two microswitch mechanisms 64 and 65 situated at each end of the slide bar (the microswitch at only one end are shown) are mounted on the back plate 51 and are closed by the presence of the sliding support member 71 and the latch 58 in its lower latching position respectively, indicating that the mechanism is suitably adjusted for knitting operation. The switches are, however, arranged in a circuit adopted to provide a "STOP MOTION" signal to the stop motion electric circuit of the knitting machine if either switch is not suitably made.

Additionally, the underside of the bottom of the housing 44 is inclined downward at a small angle towards the central region 66 of the housing and this contour produces a further conditioning down into the bed gap of the machine of the knitted course in preparation for the following knitting action.

In the preceding the actuator stops have been described on to the bed of the knitting machine but they may be provided with spring restrained movement to accommodate any differential between the point of reversal of the carriage at the end of the bed and that necessary to produce complete reversal of the restraining elements in the change-over sequence.

We claim:

1. In a knitting machine of the kind having two opposed arrays of latched needles arranged in respective flat needle beds and means for actuating the needles of the arrays independently in succession, the actuating means being borne by a carriage mounted above and movable back and forth longitudinally along the needle beds, the improvement comprising an elongated restraining element extending longitudinally between the needle beds, a housing for the restraining element also extending longitudinally between the needle beds, both the housing and the restraining element being borne by the carriage for movement therewith, the element and the housing being relatively movable longitudinally of the needle beds whereby the element can be brought to an operative position projecting from the housing or to an inoperative position retracted in the housing, and actuator means for causing the restraining element to be in its operative position during carriage motion in one direction and for causing the restraining element to be in its inoperative position during carriage motion in the opposite direction, wherein when the element is in its operative position it extends from the trailing end of the housing into an active knitting field to hold down the loops on rising needles thereof.

2. A knitting machine according to claim 1, further comprising a second restraining element borne by the carriage and a housing for the second element which may be the same as the first housing, the second element and its housing being relatively movable longitudinally of the needle beds whereby the second element can be brought to an operative position projecting from the housing or to an inoperative position retracted in the housing, the second element projecting in the opposite direction to the first element when in the operative position, the actuating means further operating to cause the second element to be in its inoperative position during carriage motion in the said one direction and in its operative position during carriage motion in the said opposite direction.

3. A knitting machine according to claim 2, wherein a separate second housing is provided for the second element, the second housing being spaced from the first housing with an active knitting field between them during motion of the carriage, and wherein a different element extends into the active knitting field for each direction of motion of the carriage.

4. A knitting machine according to claim 2, wherein a separate second housing is provided for the second element, the second housing being spaced from the first housing with two active knitting fields between them during motion of the carriage, a first of the fields being adjacent the first housing and the second of the fields being adjacent the second housing with an inactive region of the arrays between the two fields, and wherein during carriage motion in the one direction in first restraining element extends into the first field and during carriage motion in the opposite direction the second element extends into the second field, the machine further including a third housing extending longitudinally between the needle beds in the inactive region of the arrays, and third and fourth restraining elements coupled together end to end in the third housing, the coupled third and fourth elements and the third housing being relatively movable longitudinally of the needle beds whereby either one of the third and fourth elements can be brought to an operative position extending from a respective end of the third housing with the other element in an inoperative position retracted in the housing, wherein the actuating means further operates to cause the third element to be in its operating position during motion in the one direction and the fourth element to be in its operating position during motion in the opposite direction, the arrangement being such that in the operative position the third element extends into the second field and the fourth element extends into the first field.

5. A knitting machine according to claim 2, wherein the first and second elements are coupled end to end in a common housing, the elements being movable as a whole relative to the housing whereby either one may extend from a respective end of the housing with the other retracted within it, and the housing is slidable relative to the carriage in a direction longitudinally of the beds between respective positions on either side of a region of the arrays where an active knitting field occurs during motion of the carriage, and wherein the actuating means operates to cause the housing to be in a position ahead of the active knitting field during each direction of carriage motion, the actuating means further operating to cause the first element to project from the housing into the active knitting field during carriage motion in the direction and the second element to project from the housing into the active knitting field during carriage motion in the opposite direction.

6. A knitting machine according to claim 5, further including latching means for securing the housing in position relative to the carriage during carriage motion in each direction, the actuating means operating at each carriage reversal to unlatch the housing and slide it to its other position, the housing being relatched at the other position.

7. A knitting machine according to claim 3, wherein each element has an associated cam which extends through and is slidable along a slot in the associates housing, and wherein the actuating means comprises means at each end of the carriage travel which acts upon the cams directly or indirectly and slides them along their slots from one end to the other, whereby the positions of the elements are reversed.

8. A knitting machine according to claim 4, wherein each element has an associated cam which extends through and is slidable along a slot in the associates housing, and wherein the actuating means comprises means at each end of the carriage travel which acts upon the cams directly or indirectly and slides them along their slots from one end to the other, whereby the positions of the elements are reversed.

9. A knitting machine according to claim 3, in which the machine is of the V-bed type.

10. A knitting machine according to claim 4, in which the machine is of the V-bed type.

11. A knitting machine according to claim 5, further including switch means borne by the carriage for detecting if the housing and elements are not brought to their correct positions at each reversal of the carriage motion.

12. A knitting machine according to claim 6, further including switch means borne by the carriage for detecting if the housing and elements are not brought to their correct positions at each reversal of the carriage motion.

13. A knitting machine according to claim 5, in which the machine is of the V-bed type.

* * * * *